US007168781B2

(12) United States Patent
Chen

(10) Patent No.: US 7,168,781 B2
(45) Date of Patent: Jan. 30, 2007

(54) METHOD OF ENCODER SIGNAL COMPENSATION AND APPARATUS THEREOF

(75) Inventor: Chun-Chiang Chen, Hsinchu (TW)

(73) Assignee: Aetas System Incorporated (TW)

( * ) Notice: Subject to any disclaimer, the term of this patent is extended or adjusted under 35 U.S.C. 154(b) by 295 days.

(21) Appl. No.: 10/950,497

(22) Filed: Sep. 28, 2004

(65) Prior Publication Data

US 2006/0038843 A1 Feb. 23, 2006

(30) Foreign Application Priority Data

Aug. 19, 2004 (TW) ..... 93125029 A

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,889,534 A * 3/1999 Johnson et al. ..... 347/19
6,464,322 B1 * 10/2002 Dunand ..... 347/19

* cited by examiner

*Primary Examiner*—Thinh Nguyen

(57) ABSTRACT

An encoder signal compensation method and the apparatus thereof are described. The encoder signal compensation method includes the following steps. First, encoder output signals are read to calculate compensation parameters. Subsequent encoder output signals are compensated according to the calculated compensation parameters and the compensated encoder output signals are utilized to control a printing process. The encoder signal compensation method is effective in eliminating width errors and phase errors of the encoder output signals. Another embodiment of the invention is to provide a printing apparatus utilizing the encoder signal compensation method to reduce high frequency banding, effectively improving the printing quality.

20 Claims, 4 Drawing Sheets

METHOD OF ENCODER SIGNAL COMPENSATION AND APPARATUS THEREOF

BACKGROUND OF THE INVENTION

1. Related Applications

The present application is based on, and claims priority from, Taiwan Application Ser. No. 93125029, filed Aug. 19, 2004, the disclosure of which is hereby incorporated by reference herein in its entirety.

2. Field of Invention

The invention pertains to an encoder signal compensation method and the apparatus thereof. In particular, it relates to a compensation method for the encoder signals of printing apparatuses and the printing apparatus thereof.

3. Related Art

With the rapid development in the electronic industry, printing apparatuses such as copiers and printers have been widely used in daily life. Besides large companies, copiers and laser printers are already popular in various kinds of places, including families. The operations of copiers and laser printers rely on opto-electronic image printing techniques. Advanced opto-electronic image printing techniques enables manufacturers to satisfy the requirements of high-quality laser printing and the SOHO market.

The uses of color computer multimedia further increase needs in color copiers and printers. Laser printers employs complicated opto-electronic image printing configuration and procedure to form images on an output medium. The standard opto-electronic image printing procedure includes seven basic steps: charging, exposing, developing, transferring, fusing, cleaning, and erasing. The standard color printing of color printers further involves four different colors of toners: yellow, magenta, cyan, and black.

In order to increase the resolution of color laser printers, the resolution of the encoder and code strip have to be increased too. With a quadrature encoder, the resolution of a color printer can readily reach 1,200 DPI, 2,400 DPI, or higher. However, when reading signals using the quadrature encoder, the errors in the packaging precision of the encoder, the installation of the encoder, and the mechanical precision of the printer will all result in errors in the encoder signals.

The errors of a conventional quadrature encoder can be classified into phase errors and width errors. With reference to FIG. 1, the phase error and the width error of an encoder signal are illustrated. When the signal obtained by CH. A is as the solid wave 110 and that obtained by CH. B is as the solid wave 120, the quadrature signal obtained from the decoder will be as the solid wave 130. The high-level wave 112 of the solid wave 110 and the width of the low-level wave 114 are different because of the width error 140. The solid wave 110 of CH. A and the solid wave 120 of CH. B further have the phase error 150 due to the existence of a phase different. As both the width error 140 and the phase error 150 exist, the encoder produces quadrature rectangular waves with unequal widths as in the solid wave 130. This will result in high frequency banding when the printer prints, rendering a low picture quality.

Therefore, how to effectively avoiding the high frequency banding of the printer to increase the printing quality of printers and copier is what both manufacturers and users are looking for.

SUMMARY OF THE INVENTION

As seen in the above description, conventional printing apparatuses and copying apparatuses have encoder signal errors due to the mechanical precision errors, installation error of the encoder and even errors of the whole equipment. It always results in a lower printing quality.

An objective of the invention is to provide an encoder signal compensation method, which does not only effectively eliminate the width errors of the multiple encoder output signals, but also remove the phase errors at the same time.

Another objective of the invention is to provide an encoder signal compensation method, which effectively improves the output waveform of the encoder signal of printing and copying apparatuses, thereby increasing their printing quality.

According to the above objectives, the invention provides an encoder signal compensation method. The method first reads an encoder output signal and computes to obtain compensation parameters. The compensation parameters are then used to adjust the subsequent encoder output signals. The adjusted encoder output signals are utilized to control a printing process. The compensation parameters include a width error compensation parameter and a phase error compensation parameter.

The width error compensation parameter=$(1-C_1)/2C_1$ and the phase error compensation parameter=$(1-2C_2)/2C_2$. $C_1=T_S/T_L$, where $T_S$ represents the shorter wave time in a period and $T_L$ the longer wave time in the same period; $C_2=T_p/T_h$, where $T_p$ is the phase difference between the two waves and $T_h$ is half of the period. $C_1$ and $C_2$ are two constants, which are the averages obtained by reading several encoder output signals.

Another embodiment of the invention is a printing apparatus, which includes an encoder, a compensation parameter calculation unit, a compensation parameter storage unit, an encoder signal compensation unit, and a printing unit. The compensation parameter calculation unit computes a width error compensation parameter and a phase error compensation parameter for the encoder output signal and stores them in the compensation parameter storage unit. When using the printing apparatus to print a job, the encoder signal compensation unit first reads out the width error compensation parameter and the phase error compensation parameter stored in the compensation parameter storage unit and receives the subsequent encoder output signals for compensating these subsequent encoder output signals. The printing unit utilizes the compensated output signals to control a printing process. The encoder includes a quadrature encoder.

The disclosed encoder signal compensation method and the apparatus thereof forms compensation parameters from encoder signals. The invention can effectively eliminate the width and phase errors of the encoder output signals, thereby removing the high frequency bandings in printing. The printing quality of the disclosed printing apparatus is thus better.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE PREFERRED EMBODIMENT

The disclosed encoder signal compensation method can effectively remove the phase and width error in the encoder signals, thereby increasing the printing quality of copying and printing apparatuses.

Figure 1:
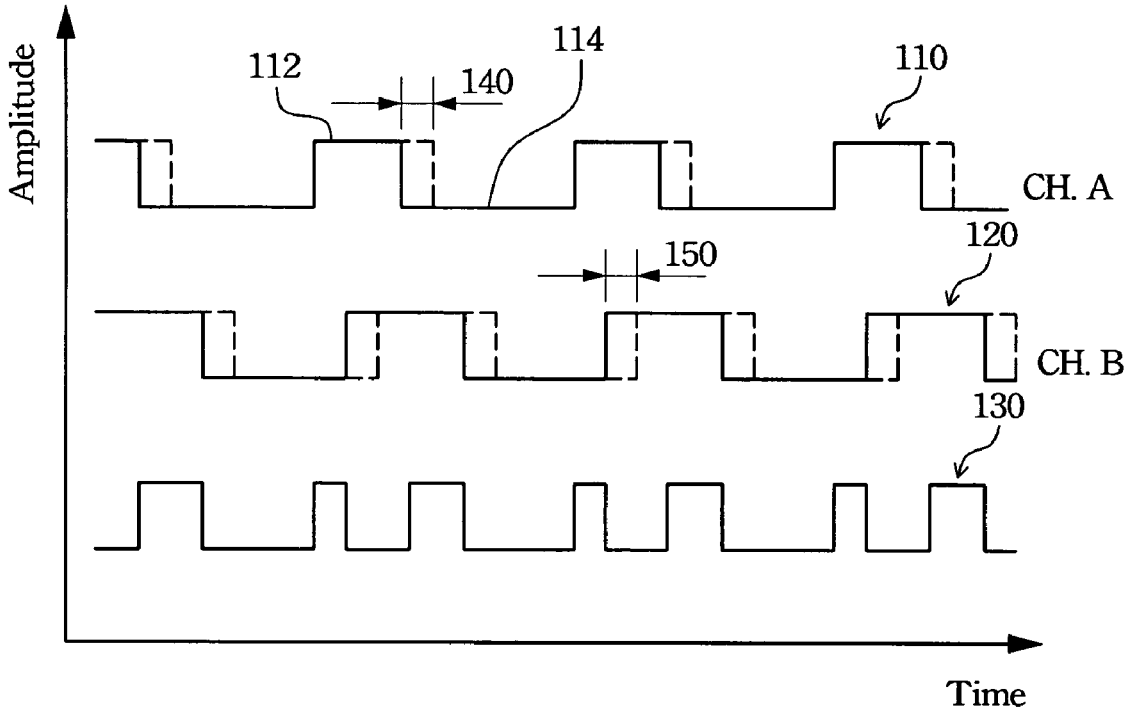
Fig. 1 (PRIOR ART)
FIG. 1 is a schematic view of phase and width errors in conventional encoder signals.
Figure 2:
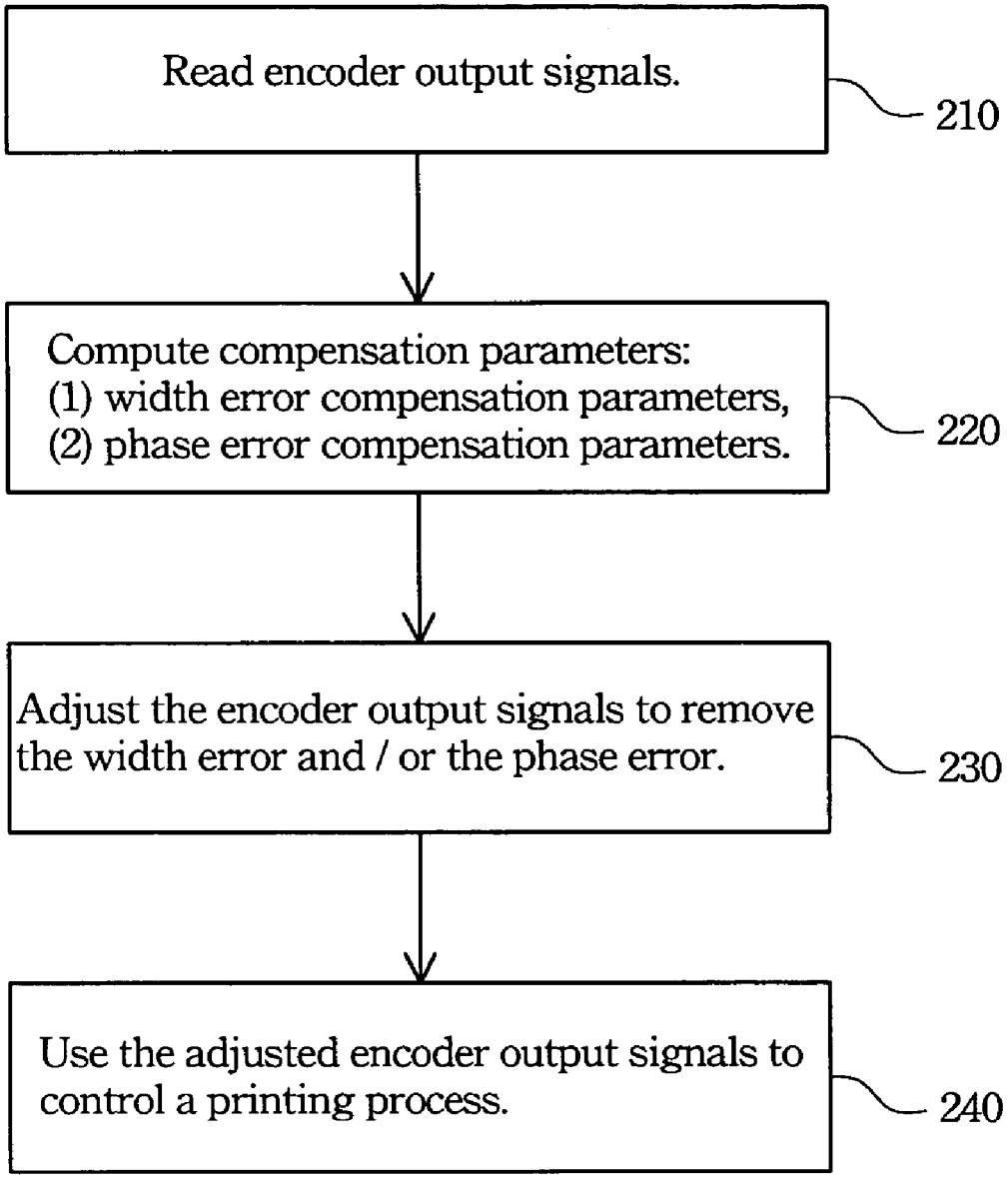
FIG. 2 is a schematic flowchart of the disclosed encoder signal compensation method.

The procedure of the disclosed encoder signal compensation method is illustrated in FIG. 2. As shown in the chart, encoder output signals are read in step 210. As the encoder is installed after a printing apparatus, its precision error and installation error are generally fixed. After many times of tests, the output signal properties are fixed once the encoder is installed on the printing apparatus.

Figure 3:
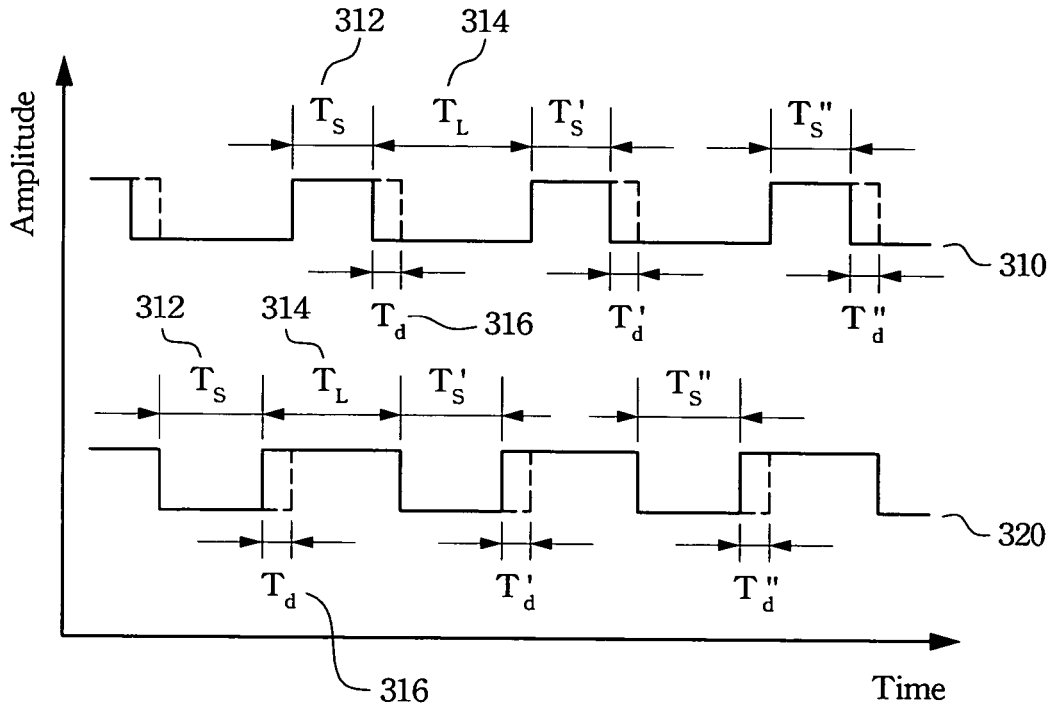
FIG. 3 is a schematic view of the width error compensation according to the invention.

Compensation parameters including a width error compensation error and a phase error compensation parameter are computed in step 220. FIG. 3 explains how to compute the width error compensation parameter using the encoder output signal. When the printing apparatus prints under a normal printing status, the output signals of CH. A and/or CH. B of the encoder have the forms as the waveform 310 and/or the waveform 320 as in FIG. 3. $T_S$ 312 represents the shorter wave in a period, while $T_L$ 314 represents the longer wave in the same period. In the case of the waveform 1 310, $T_S$ 312 represents the length of a high-level waveform and $T_L$ 314 that of a low-level waveform. In the case of the waveform 2 320, $T_S$ 312 represents the length of a low-level waveform and $T_L$ 314 that of a high-level waveform. The disclosed compensation method for encoder signals can effectively compensate the widths of the waveform 1 310 and the waveform 2 320.

When a width error exists in the output signal of an encoder, the width error is more likely to form a longer periodic change on a printing apparatus than the phase error and much easier to be detected by human eyes. Therefore, the width errors often result in obvious printing quality deterioration. The disclosed encoder signal compensation method thus first takes care of the influences resulted from the width errors.

We define $C_1=T_S/T_L$, where $0<C_1\leqq 1$ is a constant, an average obtained by reading the encoder output signals several times.

The compensation time $T_d$ 316 can be written as $$T_d=(T_L-T_S)/2=T_S/2((1/C_l)-1)=T_S((1-C_1)/2C_1) \quad (1)$$

When a short waveform $T_S$ appears, the disclosed compensation method can elongate the short waveform $T_S$ by a time period of about $T_d$, so that the lengths of high-level and low-level waveforms in each wave period are the same, thereby removing the effects of the width error on the printed image. The width error compensation parameter is $(1-C_1)/2C_1$.

Figure 4:
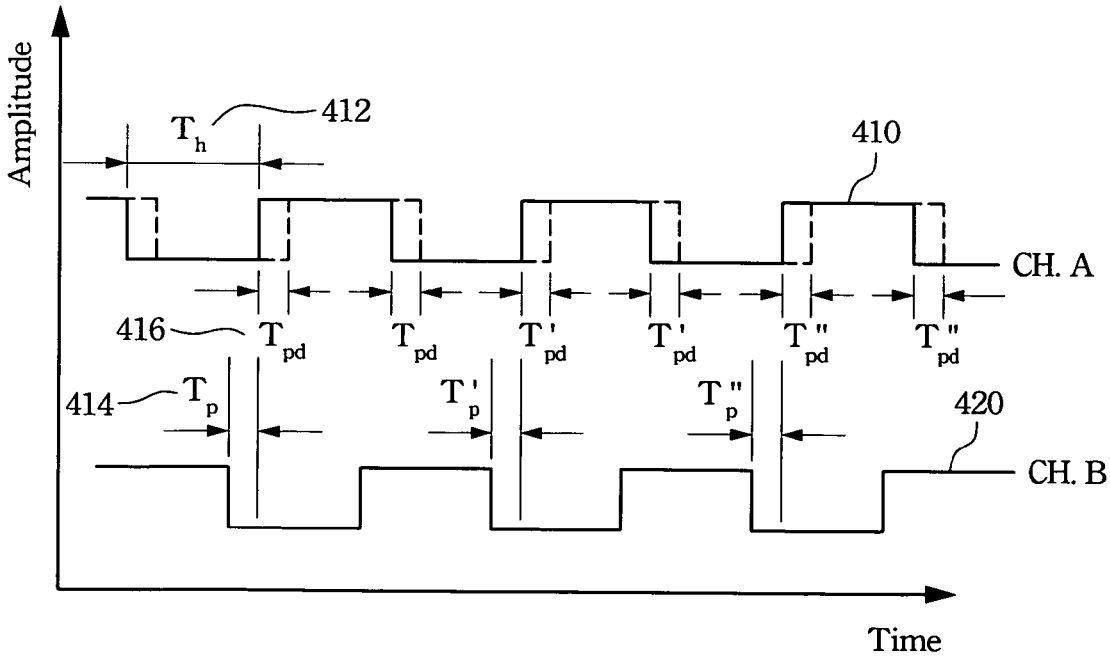
FIG. 4 is a schematic view of the phase compensation according to the invention.

After obtaining the width error compensation parameter and modifying encoder signals from width error, the method computes to obtain a phase error compensation parameter. As shown in FIG. 4, when CH. A produces an output waveform as the waveform 410 and CH. B produces an output waveform as the waveform 420, there is a phase difference $T_p$ 414 between the waveform 410 and the waveform 420. In the drawing, $T_h$ 412 represents the standard half period of CH. A and CH. B.

When there is a phase difference $T_p$ 414 between the waveform 410 and the waveform 420, the waveform 410 has to be compensated by $T_{pd}$ 416. That is to say, when a phase difference exists between the output waves of CH. A and CH. B, the latter triggered wave of CH. A is compensated in its phase by $T_{pd}$ 416, so that the rising and falling of the waveform 410 of CH. A are both delayed by $T_{pd}$ 416. After the compensation, the output waves of CH. A and CH. B have the predetermined phase difference, such as one half of the half period $T_h$ 412.

We define $C_2=T_p/T_h$, where $C_2$ is a constant, an average obtained by reading the encoder output signals several times.

The phase compensation $T_{pd}$ 416 can be written as $$T_{pd}=T_h/2-T_p=T_p/2C_2-T_p=T_p((1-2C_2)/2\ C_2) \quad (2)$$

Therefore, when the waves of CH. A and CH. B have a phase difference $T_p$ 414, the disclosed compensation method can immediately delay the wave 410 of CH. A by the phase compensation $T_{pd}$ 416 according to Eq. (2) so that the waves of CH. A and CH. B reach the predetermined phase difference. This removes the influences caused by the phase error. The phase error compensation parameter is $(1-2C_2)/2C_2$.

In step 230, the width error compensation parameter and the phase error compensation error obtained in step 220 are used to adjust the encoder output signals in order to eliminate the width and phase errors. In step 240, the printing apparatus controls a printing process according to the adjusted encoder output signals. Since the width and phase errors in the encoder output signals are already compensated by the disclosed method, the high frequency bandings can be effectively avoided in the printed images. Thus, the invention helps improving the printed picture quality.

From the above description it is clear that when there are errors in multiple encoder output signals, the disclosed encoder signal compensation method can perform width error compensations for the signals in individual channels. Afterwards, phase compensations are performed according to the phase differences in different channels. Consequently, the disclosed encoder signal compensation method is not limited to the use of a quadrature encoder. Any multiple encoder can be used in the disclosed method without departing from the spirit of the invention.

Figure 5:
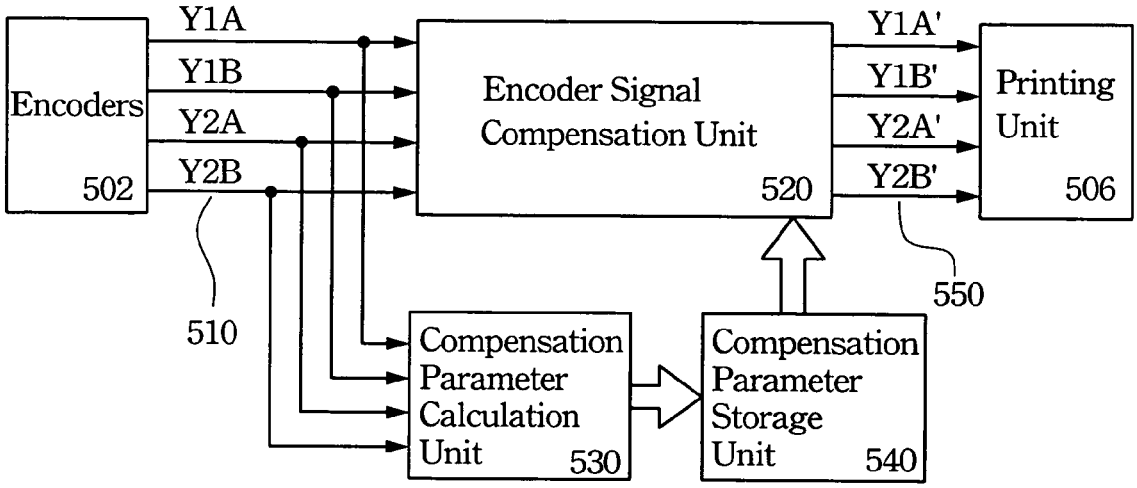
FIG. 5 is a preferred embodiment of the disclosed encoder signal compensation method implemented on a printing apparatus.

FIG. 5 is a preferred embodiment of the disclosed encoder signal compensation method. The printing apparatus of this embodiment contains an encoder signal compensation unit 520, a compensation parameter calculation unit 530, a compensation parameter storage unit 540, an encoder 502, and a printing unit 506. When the encoder 502 of the printing apparatus output a signal, the encoder output signal 510 generally has a phase and width errors due to errors in installation and mechanical precisions. When the printing apparatus of the embodiment is turned on, it first computes compensation parameters. When the printing apparatus rotates, the compensation parameter calculation unit 530 computes a predetermined times of encoder output signals 510 in order to obtain the required width and phase error compensation parameters. These parameters are stored in the compensation parameter storage unit 540. When the printing apparatus prints, the encoder signal compensation unit 520 reads the required width and phase error compensation parameters from the compensation parameter storage unit 540 in order to perform real-time compensation for the encoder output signals 510. The compensated encoder output signals 550 are output to the printing unit 506 to control a printing process.

Since the phase and width errors in the encoder output signals 510 of the encoder 502 are both compensated by the encoder signal compensation unit 520, the compensated encoder output signals can avoid the high frequency banding problem in printing. This can effectively increase the printing quality of the printing apparatus. The compensation parameter calculation unit 530 can compute the compensation parameters immediately after the printing apparatus is installed or at any time according to the user's request.

While the invention has been described by way of example and in terms of the preferred embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An encoder signal compensation method, comprising the steps of:

reading encoder output signals;

computing compensation parameters, which include at least a width error compensation parameter;

using the compensation parameters to adjust subsequent encoder output signals; and utilizing the adjusted subsequent encoder output signals to control a printing process.

2. The method of claim 1, wherein the compensation parameters further contain a phase error compensation parameter.

3. The method of claim 2, wherein the phase error compensation parameter is equal to $(1-2C_2)/2C_2$, where $C_2=T_p/T_h$, $T_p$ is the phase difference between two waves and $T_h$ is half of the period.

4. The method of claim 3, wherein the step of using the compensation parameters to adjust subsequent encoder output signals makes use of the phase error compensation parameter to adjust the phase of the subsequent encoder output signals and the phase error compensation parameter is equal to $T_p$ $((1-2C_2)/2C_2)$.

5. The method of claim 4, wherein $C_2$ is a second constant which is an average obtained by reading the encoder output signals a plurality of times in the step of reading an encoder output signal.

6. The method of claim 1, wherein the width error compensation parameter is equal to $(1-C_1)/2C_1$ where $C_1=T_S/T_L$, $T_S$ is the shorter wave time in a period and $T_L$ is the longer wave time in the same period.

7. The method of claim 6, wherein the width error compensation of the adjusted subsequent encoder output signals makes use of the width error compensation parameter, which is $T_S((1-C_1)/2C_1)$.

8. The method of claim 7, wherein $C_1$ is a first constant which is an average obtained by reading the encoder output signals a plurality of times in the step of reading an encoder output signal.

9. The method of claim 1, wherein the encoder is a quadrature encoder.

10. An encoder signal compensation method, comprising the steps of:

reading encoder output signals;

computing a width error compensation parameter and a phase error compensation parameter;

compensating width errors and phase errors in the subsequent encoder output signals; and utilizing the compensated subsequent encoder output signals to control a printing process.

11. The method of claim 10, wherein the width error compensation parameter is $T_S((1-C_1)/2C_1)$ where $C_1=T_S/T_L$, $T_S$ is the shorter wave time in a period and $T_L$is the longer wave time in the same period.

12. The method of claim 11, wherein $C_1$ is a first constant which is an average obtained by reading the encoder output signals a plurality of times in the step of reading an encoder output signal.

13. The method of claim 10, wherein the phase error compensation parameter is equal to $T_p$ $((1-2C_2)/2C_2)$ where $C_2=T_p/T_h$, $T_p$ is the phase difference between two waves and $T_h$ is one half the period.

14. The method of claim 13, wherein $C_2$ is a second constant which is an average obtained by reading the encoder output signals a plurality of times in the step of reading an encoder output signal.

15. The method of claim 10, wherein the encoder is a quadrature encoder.

16. A printing apparatus, comprising:

an encoder;

a compensation parameter calculation unit, which is coupled to the encoder to compute a width error compensation parameter and a phase error compensation parameter of an encoder output signal;

a compensation parameter storage unit, which is coupled to the compensation parameter calculation unit to store the width error compensation parameter and the phase error compensation parameter;

an encoder signal compensation unit, which is coupled between the encoder and the compensation parameter storage unit to receive subsequent encoder output signals and to compensate the subsequent encoder output signals using the width error compensation parameter and the phase error compensation parameter; and a printing unit, which is coupled to the encoder signal compensation unit to control a printing process using the compensated subsequent encoder output signals.

17. The printing apparatus of claim 16, wherein the encoder is a quadrature encoder.

18. The printing apparatus of claim 16, wherein the width error compensation parameter is $T_S((1-C_1)/2C_1)$ where $C_1=T_S/T_L$, $T_S$ is the shorter wave time in a period and $T_L$ is the longer wave time in the same period.

19. The printing apparatus of claim 18, wherein the phase error compensation parameter is equal to $T_p$ $((1-2C_2)/2C_2)$ where $C_2=T_p/T_h$, $T_p$ is the phase difference between two waveforms and $T_h$ is one half the wavelength.

20. The printing apparatus of claim 19, wherein $C_1$ is a first constant and $C_2$ is a second constant both of which are averages obtained by reading the encoder output signals a plurality of times in reading an encoder output signal.

* * * * *